US005577553A

United States Patent [19]

Fassbinder

[11] Patent Number: 5,577,553

[45] Date of Patent: Nov. 26, 1996

[54] REGENERATOR

[75] Inventor: Hans-Georg Fassbinder, Sulzbach-Rosenberg, Germany

[73] Assignee: L'Air Liquide, Societe Anonyme pour l'Etude et l'Exploitation des Procedes Georges Claude, Paris, France

[21] Appl. No.: 256,454

[22] PCT Filed: Nov. 11, 1993

[86] PCT No.: PCT/EP93/03169

§ 371 Date: Sep. 16, 1994

§ 102(e) Date: Sep. 16, 1994

[87] PCT Pub. No.: WO94/11693

PCT Pub. Date: May 26, 1994

[30] Foreign Application Priority Data

Nov. 16, 1992 [DE] Germany ..... 42 38 652.7

[51] Int. Cl.[6] ..... F28D 17/00

[52] U.S. Cl. ..... 165/10; 165/4

[58] Field of Search ..... 165/10, 9.4, 9.3, 165/9.2, 9.1, 104.16, 104.15

[56] References Cited

U.S. PATENT DOCUMENTS

| | | | |
|---|---|---|---|
| 2,272,108 | 2/1942 | Bradley | 263/19 |
| 2,428,461 | 10/1947 | Kinney et al. | 165/9.3 X |
| 3,033,544 | 5/1962 | Heuer | 165/9.3 X |
| 3,134,584 | 8/1961 | Agnew | 165/9.3 |
| 3,493,344 | 2/1970 | Clair | 165/10 |
| 4,425,764 | 1/1984 | Lam | 165/10 X |

FOREIGN PATENT DOCUMENTS

| | | | |
|---|---|---|---|
| 567573 | 3/1958 | Belgium | 165/9.3 |
| 2081823 | 12/1971 | France . | |
| 723295 | 8/1942 | Germany . | |
| 4108744 | 8/1992 | Germany . | |
| 650484 | 2/1985 | Switzerland | 165/9.1 |
| 387070 | 2/1933 | United Kingdom | 165/9.4 |

*Primary Examiner*—John Rivell
*Assistant Examiner*—Christopher Atkinson
*Attorney, Agent, or Firm*—Curtis, Morris & Safford, P.C.

[57] ABSTRACT

A regenerator is provided which has an annular heat-storage medium composed of bulk material (16) and disposed between two coaxial cylindrical gratings (2 and 3, respectively), a hot collecting chamber (4) enclosed by the inner, hot grating (3) and a cold collecting chamber (6) enclosed between the outer, cold grating (2), on the one hand, and the housing wall (1) of the regenerator, on the other, in which regenerator the hot collecting chamber (4) is closed off by a lid (9) resting on the upper rim of the hot grating (3) and there is provided, at a distance above the lid (9), a shield (11) which is attached to the housing wall (1) of the regenerator and is not physically linked to the lid (9).

12 Claims, 3 Drawing Sheets

REGENERATOR

Figure 1:
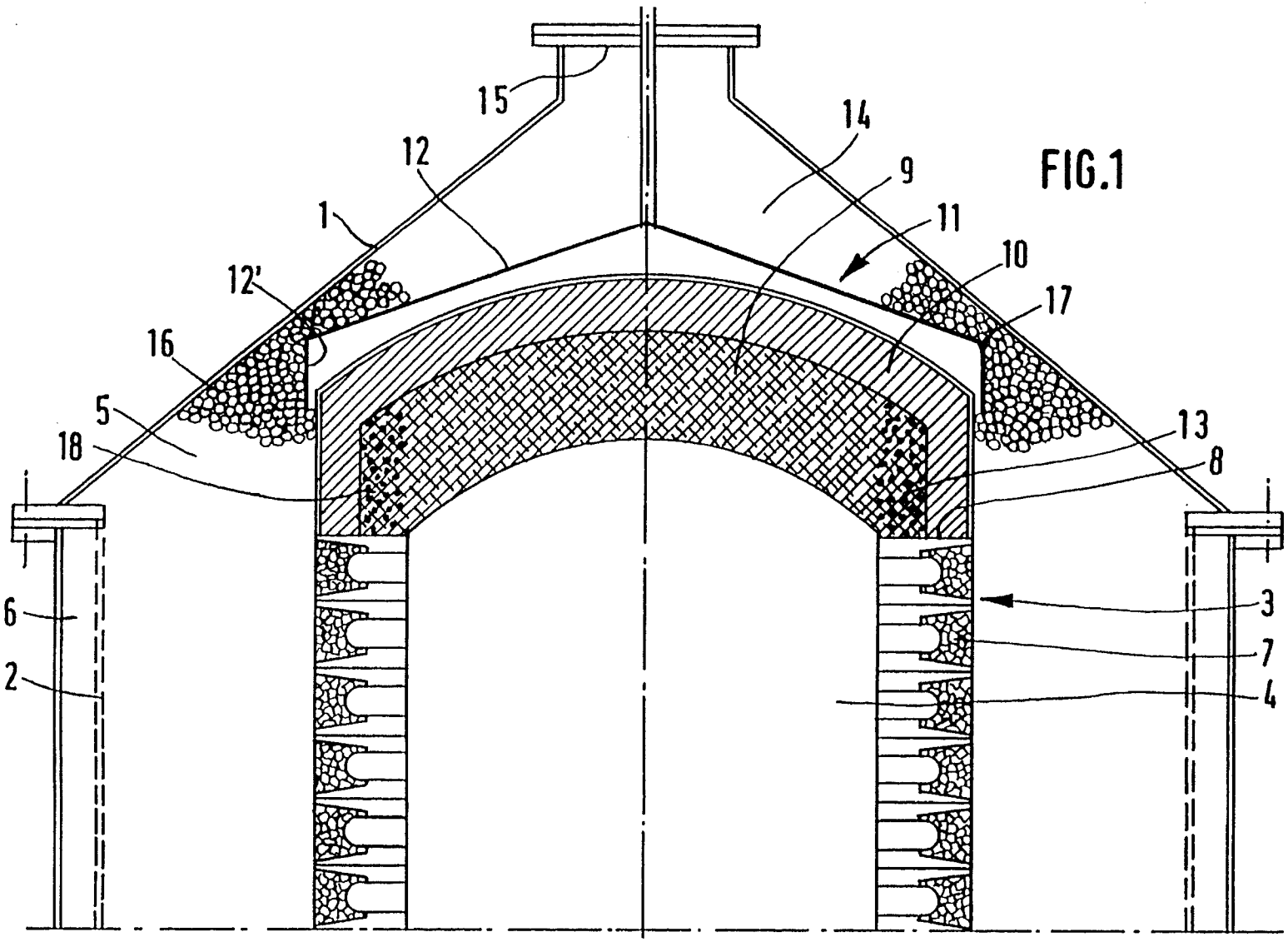

The invention relates to a regenerator having an annular heat-storage medium composed of bulk material and disposed between two coaxial cylindrical gratings, a hot collecting chamber enclosed by the inner, hot grating and a cold collecting chamber enclosed between the outer, cold grating, on the one hand, and the housing wall of the regenerator, on the other.

Such a regenerator is disclosed in U.S. Pat. No. 2,272,108. In the embodiment of the regenerator described in this publication, the hot collecting chamber is constructed with an open top and discharges into an outlet, provided in the upper part of the housing wall or in the roof of the regenerator, for the hot gases produced during the cold blasting.

The roof of the regenerator also spans the annular chamber, concentrically disposed around the hot collecting chamber, for the heat-storage medium, which is disposed between cold and hot grating. The heat-storage medium is composed of a bulk material having a particle size of 25 to 100 mm. Provided in the outside wall or the roof of the regenerator are openings through which the bulk material can be poured into the annular chamber.

The roof of the regenerator rests on the vertical housing wall of the regenerator, and specifically with the interposition of an ring beam for absorbing the thrust forces.

The annular chamber formed by the outer grating, on the one hand, and the housing wall of the regenerator, on the other, serves as collecting chamber for the cooled exhaust gases during the heating-up phase, but during the blast phase it serves to distribute the cold blast over the circumference of the regenerator or of the heat-storage medium. The result of this construction is that almost the entire outside skin of the regenerator comes into contact only with cold gas and a thermal insulation is therefore unnecessary.

The coaxially disposed inner, hot grating forms the boundary, on the one hand, of the hot side of the annular heat-storage bed and, on the other, of the cylindrical collecting chamber for the heated blast or it forms the distribution chamber for hot combustion gases. Said collecting chamber and, consequently, also the inner grating are permanently at high temperature and can therefore be constructed only from ceramic refractory components, but said ceramic components must provide an adequate permeability for the gases passing through. In particular, the use of bulk material having very small particle sizes as heat-storage medium implies that these components do allow the gases to pass through, but not parts of the bulk material.

Because of its varying temperature loading, said hot grating is subject to thermal expansions, which absolutely must be taken into consideration during its design. Thus, steps have to be taken to ensure, in particular, that gaps do not open up in the hot grating after cooling or it does not undergo alteration in its upper, open rim region in such a way that the relatively fine-grain fill can pass out of the annular chamber between cold and hot grating into the hot collecting chamber.

Thus, it is known to seal this region of the hot grating with seals in the form of a labyrinth of overlapping components, said components being made of metal because of the exposure to great heat and then having to be equipped with a water cooling system because of their linking to the outside wall of the regenerator.

The object of the invention is to eliminate said disadvantages, described above, and, in particular, to improve the operational reliability of the regenerator in this critical, hot region.

This object is achieved in a regenerator of the type mentioned at the outset, wherein the hot collecting chamber is closed off by a lid resting on the upper rim of the hot grating and there is provided, at a distance above the lid, a shield which is attached to the outside wall of the regenerator and is not physically linked to the lid.

The closing-off of the hot collecting chamber by providing such a lid ensures that, regardless of the thermal expansions taking place in the hot grating and in the lid region, no bulk material can pass into the inner collecting chamber and, on the other hand, the outside wall of the regenerator is also protected in this upper region from heat effects due to the hot gases in the inner collecting chamber.

Advantageously the lid is composed of ceramic.

This material has a high strength and has, in addition, a high heat resistance.

In a further embodiment of the invention, the lid is made of a refractory cast material and refractory reinforcement parts are enclosed in its rim region.

These reinforcement parts enable the lid to absorb thrust forces in its rim region and also tensile forces distributed over its circumference.

In this embodiment, the reinforcing rods in the rim region of the lid are disposed in the cast material horizontally and tangentially to the lid radius, and also over the height of the rim region.

This embodiment of the reinforcing parts makes it possible for them to be of relatively small construction, in particular of short length, in terms of their dimensions and to be made of a material which is not resistant to bending.

Advantageously, the reinforcing parts are high-strength ceramic rods.

Like the lid made of ceramic, said ceramic rods are also highly refractory.

In a further advantageous embodiment of the invention, the shield is constructed as a conical cover whose outer rim projects beyond the lid or the hot grating.

This embodiment of the shield ensures a complete thermal protection of the outside wall of the regenerator in this upper region.

Advantageously, an insulation is provided above the lid and below the shield.

Said insulation increases the protection of the outside wall of the regenerator and prevents, moreover, a heat loss in the region of the lid.

Advantageously, the shield along with the wall of the regenerator encloses an interspace which communicates with the chamber, enclosed by the two coaxial cylindrical hot and cold gratings, for the heat-storage medium.

This embodiment of the interspace results in a uniform charging facility for the bulk material of the heat-storage medium as a result of its annular construction.

In an advantageous further development of the invention, the hot grating is made up of individual bricks which are composed of highly heat-resistant, for example ceramic, material and have a cavity which opens into the annular chamber containing the heat-storage medium, the cavity being filled with a particularly fine-grained bulk material and a blind-hole bore being provided which, starting from that wall of the brick which is adjacent to the hot collecting chamber enclosed by the hot grating, extends into the cavity filled with bulk material.

This particular embodiment of the brick ensures that that material component of the individual bricks, or of the entire inner wall made up of such bricks, which does not directly serve to transmit or exchange heat is relatively small and, furthermore, the hot gases, or the cold gases to be heated up, can pass into the bulk material virtually without resistance through the blind-hole bore provided and can perform the heat exchange. In particular, this brick construction ensures, however, that particles of particularly small particle size can be used as heat-storage medium and the risk that the fine-grained bulk material passes through gaps and cracks, produced in the hot grating as a result of thermal expansions, into the hot collecting chamber is nevertheless eliminated.

Advantageously, the bulk material is consolidated in the cavity by a heat-resistant adhesive.

Apart from the fact that this bonding increases the compactness of the brick, it also prevents the fine-grained bulk material in the cavity of the brick from being stripped out by the bulk material descending into the annular chamber between the cold and hot grating.

Finally, the width b of the wall of the brick is less than the width B of the opposite wall.

As a result of this particular embodiment, the brick is specifically suitable for the construction of the cylindrical hot grating.

Figure 2:
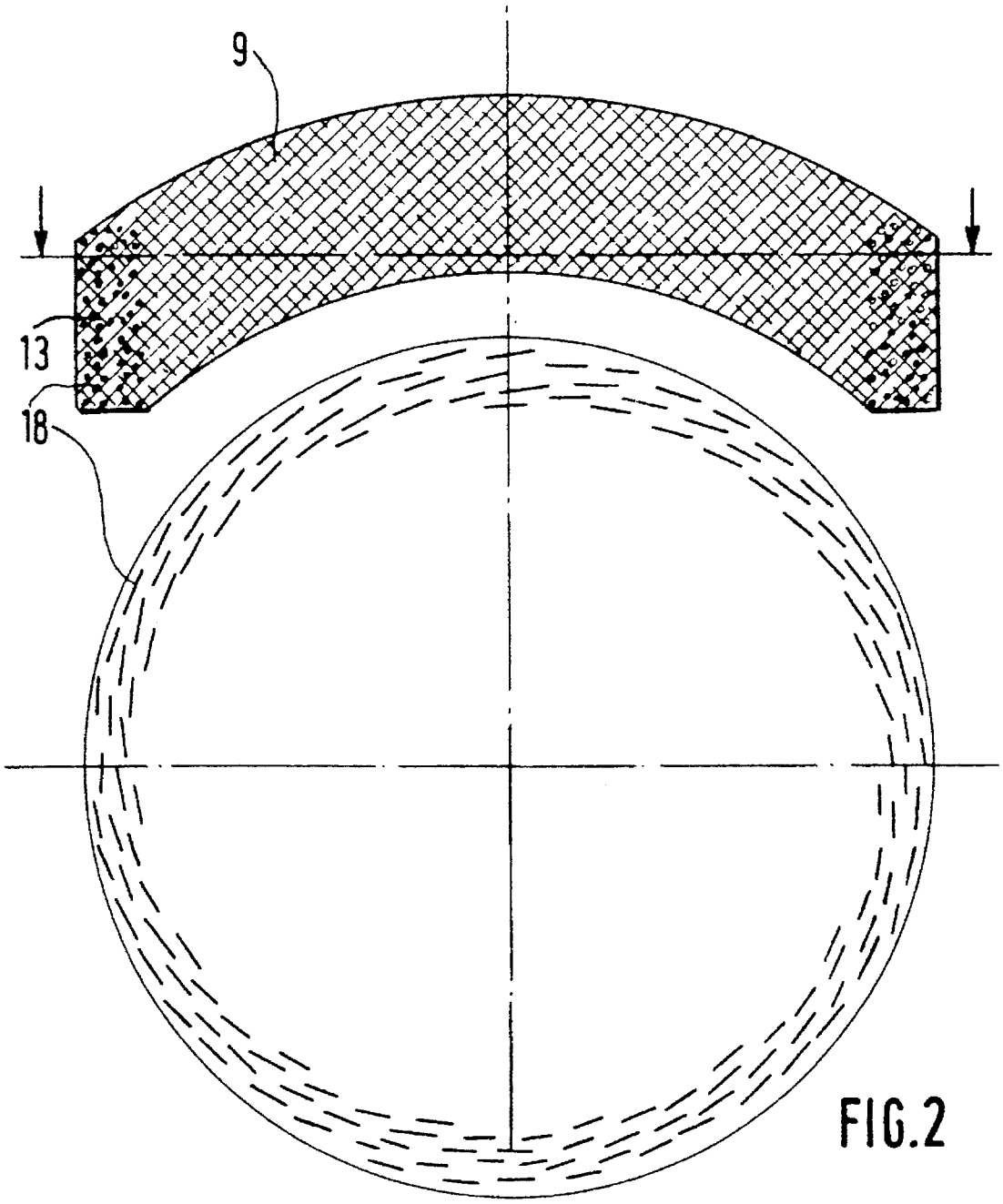
Figure 3:
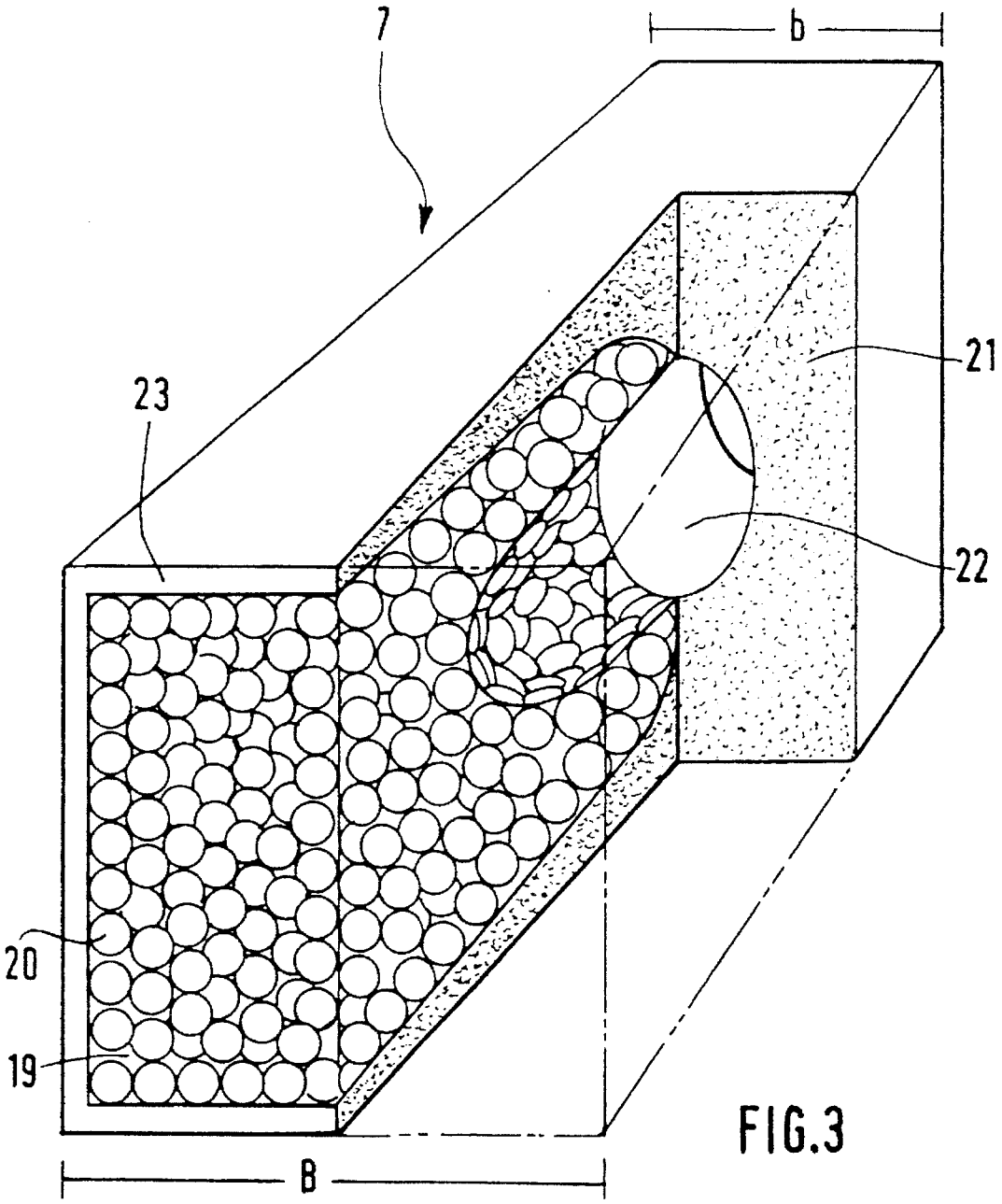

An exemplary embodiment of the invention is explained below with reference to the drawings. In the drawings:

FIG. 1 shows a vertical section through the upper region of the regenerator, FIG. 2 shows a vertical and a horizontal section through the lid, and FIG. 3 shows a perspective and partially sectioned representation of a brick.

The regenerator essentially comprises a housing wall 1 surrounding the interior of the reactor.

Said interior of the reactor is subdivided by two coaxial and cylindrical gratings 2 and 3 into a central hot collecting chamber 4 provided for the hot gases, an annular chamber 5, enclosed between cold grating 2 and hot grating 3, for the heat-storage medium, and a cold collecting chamber 6 formed by the cold grating 2 with the housing wall 1.

The cold grating 2 may be made of metal, but the hot grating 3 is erected from highly heat-resistant bricks 7 described in more detail below.

The hot inner chamber 4 is closed off by a lid 9 which rests on the upper rim 8 of the hot grating 3 and which is in turn covered by an insulating layer 10, the latter being covered in turn by a shield 11 projecting beyond the outside diameter of the hot grating 7.

The outer rim 12' of the the shield 11, which is constructed in the exemplary embodiment shown as a conical cover 12, extends beyond the rim region 13 of the lid 9 and encloses, along with the uppermost region of the housing wall 1 of the reactor, an interspace 14 which has an opening 15 through which the bulk material 16 forming the heat-storage medium can be introduced into the reactor. Said interspace 14 opens in the form of an annular gap 17 into the chamber 5 provided for receiving the bulk material 16.

This embodiment of the interspace 14 for pouring the bulk material 16 into the annular chamber 5 and distributing it therein has the advantage that only a single opening 15 has to be provided on the reactor for pouring in the bulk material 16, whereas a plurality of individual openings distributed over the circumference of the annular space 5 for the heat-storage medium are provided in the case of the known embodiments of the regenerator according to U.S. Pat. No. 2,272,108.

As a result of the fact that the upper rim 8 of the hot grating 3 is completely closed off from the chamber 5 for the heat-storage medium by the lid 9 and the insulating bed 10, the changes in the hot grating 3 brought about by the thermal expansions can no longer result in the bulk material 16 getting into the hot collecting chamber 4.

The lid 9 shown in two sections in FIG. 2 is made of a refractory ceramic cast material, reinforcing parts 18, which make it possible to support the lid on the upper rim 8 of the hot grating 3 without providing a ring beam, being provided in the rim region 13 of the lid.

Said reinforcing parts 18 are composed of relatively short and high-strength ceramic rods which are in each case disposed in the rim region 13 horizontally and tangentially to the radius of the lid 9. All said ceramic rods, which are distributed over the entire peripheral circumference of the lid 9 form, as a result of their solid anchorage in the ceramic cast material of the lid 9, a completely integrated ring beam which is able to absorb the forces occurring in this region. This type of reinforcement of the lid ensured that the lid 9 cannot be destroyed by the variations in temperature which occur.

The bricks 7 of which the hot grating 3 is constructed are also composed of highly heat-resistant materials. In this respect, reference is made to FIG. 3 which shows an enlarged and perspective representation of such a brick 7.

Preferably, a ceramic material is used, and the solid parts, that is to say those having no passages, of the individual brick 7 should be made as small as possible compared with its total volume.

For this purpose, the brick 7 shown has a cavity 19 which is closed off on all sides of the brick 7 by the respective ceramic walls, with the exception of that wall 23 which extends into the annular chamber 5 for the heat-storage medium. Said cavity 19 is filled with pellets, the latter being mutually consolidated and secured against dropping out of the brick 7 by a heat-resistant adhesive.

The wall 21 which is opposite the wall 23 and extends into the hot collecting chamber 4 of the regenerator has a blind-hole bore 22 which extends comparatively far into the cavity 19 filled with pellets 20 and allows the entry of the hot gases into the heat-storage medium, or the exit of the heated cold gases into the collection chamber 4 of the regenerator.

According to FIG. 3, the brick 7 has a partially conical shape, namely the width b of the wall 21 is less than the width B of the wall 23. Height and length of the brick 7 are the same on all sides. This embodiment of the brick 7 is particularly suitable for erecting the annular hot grating 3.

I claim:

1. A regenerator having an annular heat-storage chamber composed of bulk material and disposed between two coaxial cylindrical gratings wherein one of the gratings is an inner, hot grating and the other of the gratings is an outer, cold grating, a hot collecting chamber enclosed by the inner, hot grating and a cold collecting chamber enclosed between the outer, cold grating, on the one hand, and a housing wall of the regenerator, on the other, wherein the hot collecting chamber is closed off by a lid resting on an upper rim of the hot grating and wherein at a distance above the lid, a shield attached to the housing wall of the regenerator which is not physically linked to the lid.

2. The regenerator as claimed in claim 1, wherein the lid is made of a refractory cast material and refractory reinforcing members anchored in the refractory cast materials which are enclosed in its rim region.

3. The regenerator as claimed in claim 2, wherein the lid is composed of ceramic.

4. The regenerator as claimed in claim 2, wherein said rim region is of a predetermined height and the reinforcing members in the rim region of the lid are disposed in the cast material horizontally and tangentially to the lid radius, and also over the height of the rim region.

5. The regenerator as claimed in claim 4, wherein the reinforcing members are high-strength ceramic rods.

6. The regenerator as claimed in claim 1, wherein the shield is constructed as a conical cover having an outer rim projecting beyond the lid.

7. The regenerator as claimed in claim 6, wherein an insulation is provided between the lid and the shield.

8. The regenerator as claimed in claim 1, wherein the shield encloses, along with the housing wall of the regenerator, an interspace which communicates with the annular chamber, enclosed by the respective cold and hot gratings.

9. The regenerator as claimed in claim 8, wherein the communication between the interspace, on the one hand, and the chamber for the heat-storage medium is constructed as an annular gap.

10. The regenerator as claimed in claim 1, wherein the hot grating is made up of individual bricks which are composed of highly heat-resistant material and have a cavity which opens into the annular chamber, the cavity being filled with a bulk material and a blind-hole bore being provided which, starting from a first wall of the brick having a width b which is adjacent to the hot collecting chamber enclosed by the hot grating, extends into the cavity filled with bulk material.

11. The regenerator as claimed in claim 10, wherein the bulk material is consolidated in the cavity by a heat-resistant adhesive.

12. The regenerator as claimed in claim 11, wherein a second wall having a width B is positioned opposite to said first wall and the width b of the first wall of the brick is less than the width B of the second wall.

* * * * *